US011286624B2

(12) United States Patent
Vazquez Ruiz Del Arbol

(10) Patent No.: US 11,286,624 B2
(45) Date of Patent: Mar. 29, 2022

(54) REDUCED-THICKNESS REINFORCED CONCRETE PAVEMENT

(71) Applicant: José Ramón Vazquez Ruiz Del Arbol, Madrid (ES)

(72) Inventor: José Ramón Vazquez Ruiz Del Arbol, Madrid (ES)

( * ) Notice: Subject to any disclaimer, the term of this patent is extended or adjusted under 35 U.S.C. 154(b) by 59 days.

(21) Appl. No.: 16/620,440

(22) PCT Filed: Jun. 6, 2018

(86) PCT No.: PCT/ES2018/000051
§ 371 (c)(1),
(2) Date: Dec. 6, 2019

(87) PCT Pub. No.: WO2018/224707
PCT Pub. Date: Dec. 13, 2018

(65) Prior Publication Data
US 2020/0199827 A1 Jun. 25, 2020

(30) Foreign Application Priority Data
Jun. 8, 2017 (ES) ..... ES201700625

(51) Int. Cl.
*E01C 11/00* (2006.01)
*E01C 11/18* (2006.01)
*E01C 11/04* (2006.01)

(52) U.S. Cl.
CPC ..... *E01C 11/18* (2013.01); *E01C 11/04* (2013.01)

(58) Field of Classification Search
CPC ..... E01C 11/04; E01C 11/18
USPC ..... 404/17–46, 72–75, 93, 94
See application file for complete search history.

(56) References Cited

U.S. PATENT DOCUMENTS 1,556,178 A * 10/1925 Tallaksen ..... E04C 5/16 52/649.4
1,634,653 A * 7/1927 Bruno ..... E04F 15/14 404/55
2,094,853 A * 10/1937 Shaw ..... E01C 11/14 404/56
3,972,640 A * 8/1976 Miller ..... E01C 11/14 404/62
4,449,844 A 5/1984 Larsen
4,733,513 A * 3/1988 Schrader ..... E04B 1/483 404/56
5,073,062 A * 12/1991 Leone ..... E01C 19/43 404/75
5,711,631 A * 1/1998 Amon ..... E01C 23/025 404/74
5,733,470 A * 3/1998 Roth ..... E01C 9/001 249/129

(Continued)

FOREIGN PATENT DOCUMENTS

DE 4328831 A1 4/1994
WO 2005007970 1/2005
WO 2013053001 4/2013

*Primary Examiner* — Raymond W Addie
(74) *Attorney, Agent, or Firm* — Maschoff Brennan

(57) ABSTRACT

A pavement (11) formed by an assembly of concrete slabs (13) of thickness H, each slabs (13) comprising a plurality of superficial grooves (15, 17) of height H3, delimiting sub-slabs (21) and, as reinforcement, an assembly of tie bars (25, 27; 26, 28) for tying adjacent sub-slabs (21) on either sides of said superficial grooves (15, 17), the bars being disposed below the sub-slabs at a distance H2.

9 Claims, 3 Drawing Sheets

(56) References Cited

U.S. PATENT DOCUMENTS 5,870,869 A * 2/1999 Schrader ..... E01C 11/14 52/396.02
6,745,532 B1 * 6/2004 Vazquez Ruiz del Arbol ..... E01C 11/04 52/414
7,080,955 B2 * 7/2006 Gregg ..... E01C 19/238 404/122
7,441,984 B2 * 10/2008 Kramer ..... E01C 11/14 404/52
7,517,171 B2 * 4/2009 Coats ..... E01C 19/43 404/89
7,845,131 B2 * 12/2010 Hough ..... E04B 1/68 52/514.5
7,850,393 B2 * 12/2010 Hamel ..... E01C 5/06 404/36
8,007,199 B2 * 8/2011 Shaw ..... E01C 11/14 404/74
8,132,981 B2 * 3/2012 Castonguay ..... E04F 13/147 404/41
8,336,274 B2 * 12/2012 Riccobene ..... E04B 2/12 52/604
8,453,413 B2 * 6/2013 Matiere ..... E04B 5/40 52/741.41
8,470,229 B2 * 6/2013 Nasvik ..... E01C 19/44 264/293
8,672,580 B1 * 3/2014 Garceau ..... E01C 19/43 404/75
8,840,336 B2 * 9/2014 Smith ..... E04B 1/41 404/56
2014/0017005 A1 * 1/2014 Oates ..... E01C 11/02 404/47
2015/0249862 A1 9/2015 Heun et al.
2016/0010289 A1 * 1/2016 French ..... B28B 23/043 52/223.6
2017/0002524 A1 1/2017 Seong et al.

* cited by examiner

REDUCED-THICKNESS REINFORCED CONCRETE PAVEMENT

FIELD OF THE INVENTION

This invention relates to a reinforced concrete pavement of reduced thickness.

The invention is applicable to linear and surface works such as roads, highways, concrete esplanades, etc.

BACKGROUND OF THE INVENTION

Continuous reinforced concrete pavements are placed in neutral fiber reinforcements to join the elements resulting from the cracks that occur in it. Longitudinal amounts of steel, of around 0.6% to 0.7% of the concrete section, achieve a tensile strength of steel greater than that of concrete in sections perpendicular to the axis of the road, and the steel does not break but the concrete cracks. The cost of steel is expensive and there are problems when building the pavement.

The metal mesh used in warehouses in the upper part of the pavement aims to avoid concrete shrinkage joints and also allows building concrete without joints. It also requires the use of reinforcement throughout the pavement as a way to control the shrinkage of concrete and cracks caused by loads.

Among the drawbacks of known reinforced concrete pavements, their great cost can be highlighted.

The object of this invention is to solve that problem.

SUMMARY OF THE INVENTION

The invention presents a pavement formed by a set of concrete slabs (of a surface preferably between 2×2 m2 and 25×25 m2) of an H thickness (preferably between 6-80 cm), in which each of these slabs comprises several superficial grooves (preferably parallel to the slab edges) of an H3 height delimiting sub-slabs (of a surface preferably between 0.4×0.4 m2 and 5×5 m2) and, as reinforcement a set of tie bars of adjacent sub-slabs on both sides of these superficial grooves.

Preferably, the sum of H2, the distance from the superficial grooves to the tie bars, and H3 should be less than H/2.

In one embodiment, the tie bars are perpendicular to the superficial grooves. For constructive reasons, the set of tie bars between two sub-slabs includes secondary tie bars so that it is mesh-shaped.

In another embodiment, the tie bars have an appropriate shape to be located alternately on one side and another of the superficial grooves and arranged below them at an H2 distance. The length of these tie bars can be between 1.5 and 5 times the length of the superficial grooves of H3 height.

Preferably the tie bars are corrugated stainless steel bars with a diameter between 2-10 mm.

Thus, in their upper part, the cross-sections of the pavement are weakened on the one hand, and reinforced on the other hand to nullify in this manner the positive bending moments (lower tractions and upper compressions). In this manner, with the passage of time, in each of the initial slabs of the pavement smaller sub-slabs interlocked together will be formed.

This structuring of pavement allows to reduce in an efficient way the tensile stresses of concrete pavements to bring about a greater durability, a reduction in the thickness of the slabs, an increase in the horizontal dimensions of the slabs (with the consequent decrease in the number of shrinkage joints) and a larger soil surface area for the distribution of vertical pressures.

Positive bending moments are reduced under loads on the initial slabs due to the decrease in the size of the sub-slabs. These moments are zero on unloaded sub-slabs. The efficient transmission of loads to the adjacent slabs contributes to the distribution to the soil through the slabs near the loaded slab.

That is, in the initial slab, the negative bending moment is transmitted (upper tractions and lower compressions), which is a favorable bending moment. The positive bending moment, which is unfavorable, becomes zero from the edges of the loaded sub-slab to the outside.

The tensile stress in the lower fibers are those that break the pavement, therefore, the existence of upper tensile stress is considered favorable, because it implies that there are compressions below that reduce the magnitude to the tensile stress existing under the load in the inferior fibers.

The negative bending moments are smaller than the positive ones, once the sub-slabs are created.

By combining the present invention with the possibility of transferring loads between slabs, permanently, we can obtain a pavement consisting of sub-slabs of smaller thickness and greater durability.

Another consequence is to be able to increase the contact surface area with the support soil, allowing soils with lower support capacity.

Other consequences are being able to reduce the reinforcements of reinforced slabs or to design continuous concrete pavements in a different way.

Some sections of slabs are weakened by the fresh execution of superficial vertical grooves or with subsequent cuts of the pavement. In these same places, reinforcements are previously installed to sew both parts of the sections. An initial slab will form fissures in such sections, due to the bending moments that have tensile stresses below and compressions above, because in these sections the thickness is smaller, and the reinforcements are preferably located on the top to optimize the amount to be used.

Inside the initial slabs, smaller sub-slabs joined by the placed reinforcements will be formed. For sub-slabs without loads, positive bending moments are equal to zero and the negative moments are transmitted due to the reinforcements.

The concrete reinforcement can be discontinuous because the places where there will be cracks are known and it is possible to sew only the fissures, not the entire surface of the pavement.

The surfaces on both sides of a rough fissure, formed by the aggregates of the concrete in contact will transmit the load between small sub-slabs joined by the reinforcements and also transfer the bending moment when there are tensile stress in the upper part behaving like a section without fissure, in relation to the negative moments.

These bending moments can transmit compressions to corresponding critical sections (normally the one that contains the load or acting loads), decreasing their tensile stress in the lower fibers, if there is contact among the lower fibers of the loaded sub-slab with the adjacent ones.

The edges of the sub-slabs are inches that rotate between slabs in one of the directions. The tensile stresses in the lower fibers of the unloaded slabs disappear.

The pavement requires, at certain distances, a transmission system that allows the initial slabs to expand and contract.

Pavements design requires smaller thicknesses for the same durability due to the decrease in stresses achieved by joining and weakening the pavement in the upper part.

To use small amounts of steel, the initial slab length cannot be indefinite and joints are required. However, due to the width of the road, which is not a large width (of around 10 meters), this can be made with a single initial slab. For an esplanade there must be joints in both directions.

The critical stress for concrete is the tensile stress and the maximum tensile stress usually occurs under the load and in the lower fibers. When the edges of the initial slab are rigidly or elastically supported on the edges of the adjacent slabs, the maximum tensile stress is always under the load, on the lower fiber and with the load in the center of the slab.

Other features and advantages of this invention will be apparent from the following detailed description of implementations that show their goals as can be seen in the following figures.

DETAILED DESCRIPTION OF THE INVENTION

Figure 1:
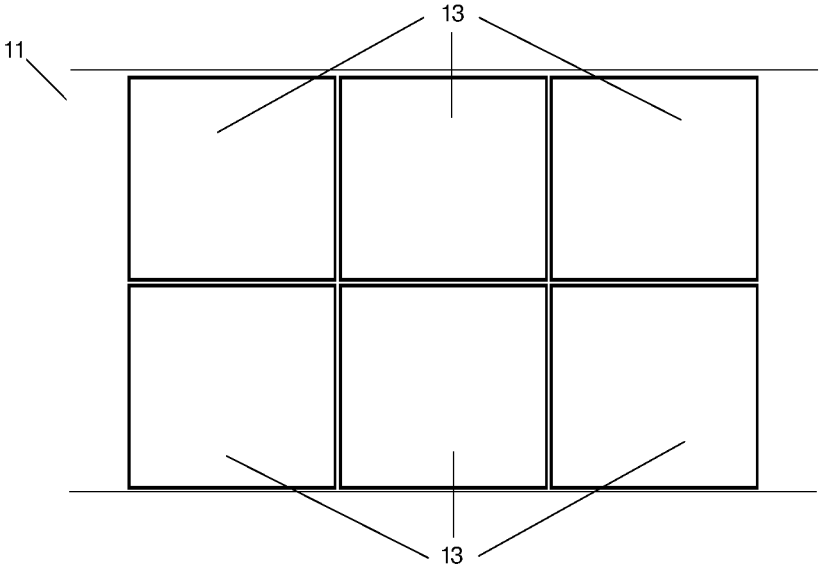
FIG. 1 is a horizontal view of a pavement formed by two rows of slabs.
Figure 2A:
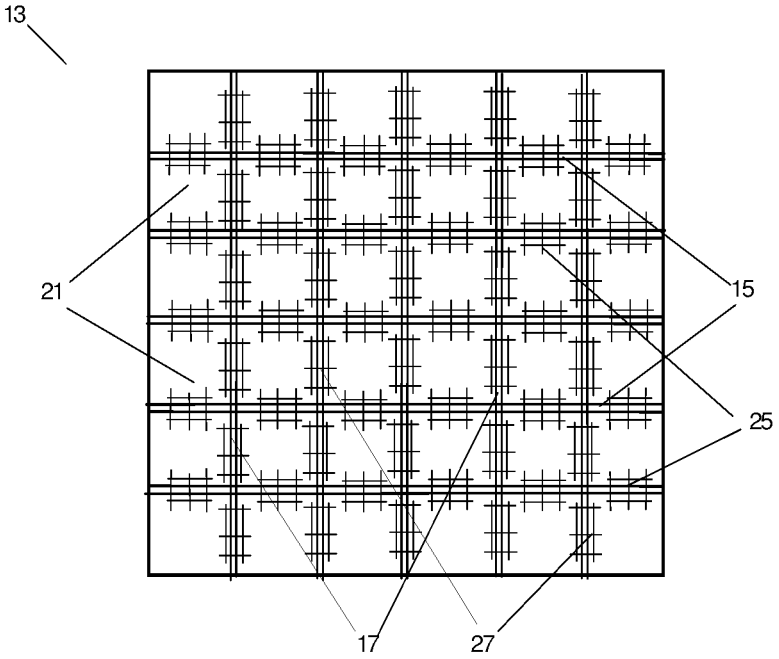
FIGS. 2*a* and 2*b* are schematic horizontal views of one of the pavement slabs according to the invention that show two options of the tie bars.
Figure 2B:
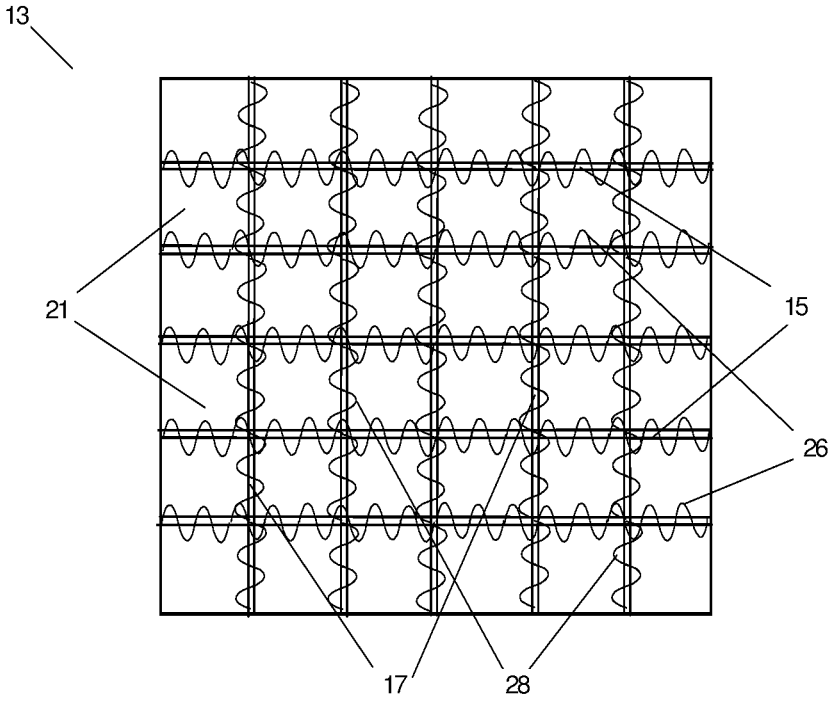
Figure 3:
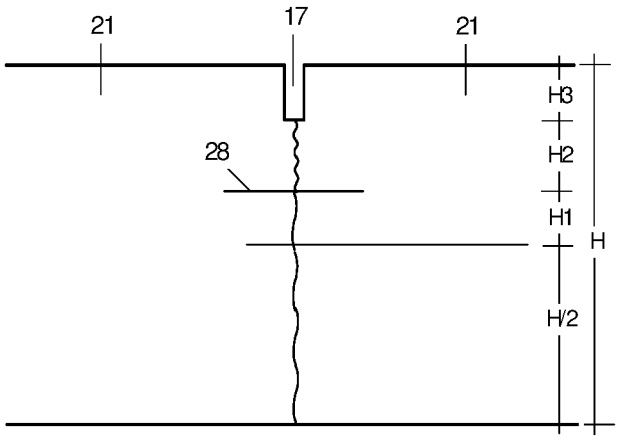
FIG. 3 is a partial schematic sectional view of a pavement slab with a vertical superficial groove and a tie bar of the two sub-slabs that are generated on both sides.

Pavement 11 is formed by slabs 13 connected to each other to transfer the edge loads and allow horizontal expansion movements. Its thickness can be optimized with the consequent cost reduction and greater durability by inducing the subdivision of each of them into several sub-slabs 21 to produce lower flexural tensile stresses, by means of longitudinal grooves 15, 17 of an H3 height and tie bars 25, 27; 26, 28 arranged below them at an H2 distance.

In this way, shear forces can be transmitted on a pavement in a lasting way, with aggregates on both sides of a fissure, without interposition of any element and without separation among these aggregates.

This fissure must have a zero width so that the aggregates of one of its sides rest on the aggregates of the other side. If there is a gap, the transfer will not be good because the support among aggregates is not horizontal and the system will not be durable.

The objective of zero width of the fissure is achieved with tie bars 25, 27; 26, 28, since in the concrete coinciding with its perimeter, which is adhered to them, there is no separation among aggregates, since tie bars 25, 27; 26, 28 are not broken. That is, the zero width of the fissure is achieved between the lower and upper parts of tie bars 25, 27; 26, 28.

The upper part is rough due to aggregates, since the fissure between the lower edge of grooves 15, 17 and tie bars 25, 27; 26, 28 is produced by tensile stress of the upper part of the slabs 13. The fissure stops, because that tensile stress is supported by tie bars 25, 27; 26, 28.

Between tie bars 25, 27; 26, 28 and the bottom of slab 13 cracks are formed caused by the loads due to the bending moments, whose tensile stress start at the bottom. These fissures can break without contouring the aggregates producing a lower degree of roughness than the one produced above tie bars 25, 27, 26, 28.

Figure 4A:
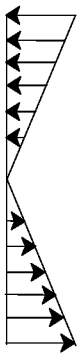
FIG. 4*a* is a diagram that schematically shows the stress distribution of a positive bending moment in a section of a slab of H height with tensile stress below and compressions above, due to a vertical load down.
Figure 4B:
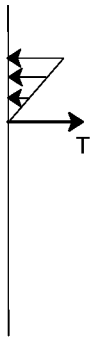
FIG. 4*b* is a diagram schematically showing the distribution of perpendicular stresses in an edge section of a sub-slab with a tie bar at an H2 distance from the bottom of a superficial vertical groove of H3 height due to a tangent load to a side of this groove.

Whereas tie bars 25, 27, 26, 28 must "sew" the fissure at points that are on a horizontal line (parallel to the surface), so that the section can rotate in relation to this line, the points above (between tie bars 25, 27, 26, 28 and the bottom of grooves 15, 17) will be compressed and the points below will no longer have contact and have no stresses, as seen in FIG. 4*b*.

On the other hand, the tie points of the tie bars 25, 27, 26, 28 must be close to each other. This is not usually done on roads with 1-meter distances between tie bars, which can fulfill the assigned binding function of avoiding separations between slabs, but not with the binding that this invention requires, which is a theoretical separation of zero among aggregates to avoid dynamic friction among them that would impair the durability. The tied points separated from each other at a distance less than the height of the pavement are a suggested or adequate solution. It is better if they are closer to each other.

Preferably the location of tied points should be as high as possible, because the transmission of bending moments to upper tensile stresses is required. The reinforcement must be as far away as possible from the lower edge to withstand greater negative bending moments. A possible option is the placement of the reinforcement with its upper part tangent to the lower part of the groove.

Figure 5A:
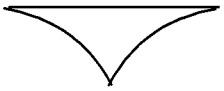
FIGS. 5*a* and 5*b* are diagrams showing the deformations in a slab section according to the invention with the load acting in a groove and inside a sub-slab.
Figure 5B:
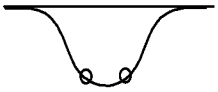
Figure 5C:
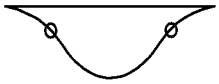
FIG. 5*c* is a diagram similar to that of FIGS. 5*a* and 5*b* in a conventional slab, with the edges supported on the adjacent slabs, in which the existing inflection points and the distance or separation between them can be observed, which produced big positive bending moments.

The load must be transferred to the greatest possible extension of the soil, forming a convex curvature on both sides of sub-slabs 21 on which the load acts, as shown in FIGS. 5*a* and 5*b*, by transmitting the negative bending moments.

For the correct execution of pavement 11 according to the invention, tie bars 25, 27; 26, 28 must be sized depending on the depth of superficial grooves 15, 17 and they have to be placed at an H2 height in relation to them.

As for superficial grooves 15, 17, they can be made on fresh concrete with a roller that carries a disc at its midpoint, together with a back plate that initially maintains the groove or by cutting the hardened pavement.

In addition to superficial grooves 15, 17, it may be convenient to place a plastic or a rubber (not shown in Figures) on the ground to vertically induce the fissure from the bottom up. This rubber can also waterproof the fissure in an optimal manner.

Regarding the behavior of the pavement according to the invention, it can be seen in the following FIG. 4*a* that, when the load is located at an internal point of sub-slab 21 with an H thickness, tensile stresses are located at the bottom.

When the load axis is on an edge between sub-slabs 21 there is no shear force to be transmitted, since the distribution to both support sub-slabs is identical. The upper part tends to come together and the lower part to separate. For there to be contact between fissure walls, the tensile strength of the reinforcement (see FIG. 4*b*) must be equal to the compressive forces of the concrete produced between the tie bars 25, 27; 26, 28 and longitudinal grooves 15, 17.

Figure 4C:
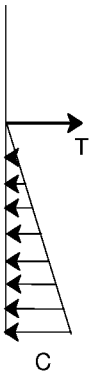
FIG. 4*c* is a diagram schematically showing the distribution of perpendicular stresses in an edge section of a sub-slab with a tie bar at an H1 distance from half of the slab of H height, due to a negative bending moment.
Figure 4C:
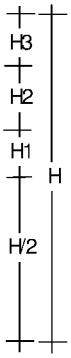

When there is support between the edge sections of sub-slabs 21, stresses occur, as shown in FIG. 4*c*. Compression stresses C are the same as tensile stresses T=c*(H/2+H1)/2. The negative bending moment is ½*c*(H/2+H1)*(H/2+H1)*⅔, or T*⅔*(H/2+H1). Therefore, H1 must be as large as possible so that traction T is as low as possible.

We know that small slabs have small bending moments and involve a greater number of joints. If we have a solution of cheap and effective joints we can cut up slabs 13 into smaller portions that produce smaller stresses and allow us to reduce the original thicknesses of slabs.

Due to the transmission of negative moments, slabs can be made that are larger than the original 13.

The minimum amount of reinforcement corresponding to tie bars 25, 27; 26, 28 should be such that:

1. They can support the braking of vehicles. In critical situations of zero friction between the soil and the pavement, it can be assumed that braking is only supported by the reinforcement. An indicative amount for roads can be (13000/2)*0.4=2,600 kg of traction per meter. It is equivalent to 4 tying points of 4 mm in diameter, that is, every 25 cm.

2. They can exceed the friction with the soil due to the shrinkage of the slab concrete. The larger the slab 13 the greater that amount will be. For example, slab 13 of 8×8×0.20 m, with a coefficient of friction with the soil of 0.5 and with a specific weight of 2.5 kg/cm2 will have a traction per meter towards the center of the slab of (8/2)*0.2*2.5*0.5=1 Ton=1,000 kg, with the edges of the sub-slabs 21 needing two tying points of 4 mm in diameter per meter, that is, every 50 cm.

3. The tensile strength of the reinforcement will endure the negative bending moments due to the cantilever position to which sub-slabs 21 that are out of the load tend. If we consider, for the same slab, the moment by its own weight of a 1 meter overhang, that is, 0.2*2.511*0.5=0.25 m*ton/m and H1=6 cm, we have a T traction of 2.34 tons per meter of groove, since T*2/3*(0.20/2+0.06)=0.25. Four 4 mm Diameter Tying Points are Needed, which correspond to every 25 cm.

4. A rather unfavorable case is when the aggregates of the rough surface between the bottom of longitudinal grooves 15, 17 and tie bars 25, 27; 26, 28 lose their macro roughness over time, or when H2 is almost zero, that is, when tie bars 25, 27; 26, 28 are tangent to the bottom of grooves 15, 17. Between fissure surfaces, we will consider a coefficient of static friction of 0.6 and a shear force to be transferred, which in the worst case will be half the load. The tensile force between surfaces will be perpendicular to the shear stress.

For roads, the traction for the 13-ton axis, whose maximum shear stress in 3 meters would be 13/2, would produce (13/2)/3)/0.6=3.6 tons per meter of groove, needing one 4 mm tie point every 18 cm.

5. The traction that resists the reinforcement must be greater than the concrete compressions that exist between the reinforcement and the lower part of grooves 15, 17, shown in FIG. 4*b*.

The maximum amount is that in which the compressive strength of the reinforcement is lesser than the compressive strength of the concrete above the reinforcement, since the fissure of the lower part (from the reinforcement downwards) would not be formed by loads where we need this; we would also have to weaken the bottom part. For the same case as the previous one (H=20 cm and H1=6 cm), it would be ½*4*300*100=5000*S. The result is S=12 cm2. This means that the tensile strength of the reinforcement must be less than 60,000 kg per meter, that is, less than 11 tied points with 12 mm diameters per meter.

Before the groove, the reinforcement must be placed, which can be a curved bar forming alternating semicircles around the axis of the groove. The radius determines the tied points provided by the bar.

The object of this invention does not include placing the reinforcement, because there are multiple procedures and they are relatively simple.

However, placing reinforcements is proposed, with fresh concrete, on a platform or two with grooves of adequate width. Rollers with separate spikes plow that width to decompress the concrete. The reinforcements are placed on the decompressed surface according to the depth where the reinforcements will be and with another roller, with two discs with small perimeter holes, the reinforcements will be attached appropriately and introduced into the loose concrete mass. Finally, on the platforms, a roller with a central disc and a smoothing-vibrating plate, with a plate of the appropriate depth, groove will be made in fresh concrete.

Although the present invention has been described in connection with various implementations, it can be seen from the description that various combinations of elements, variations or improvements can be made therein that are within the scope of the invention defined in the appended claims.

The invention claimed is:

1. Pavement (11) formed by a set of concrete slabs (13) with an H thickness, characterized by:

each of these slabs (13) has several superficial grooves (15, 17) of an H3 height delimiting sub-slabs (21);

comprises, as reinforcement, of a set of tie bars (25, 27; 26, 28) of sub-slabs (21) adjacent to both sides of these superficial grooves (15, 17) that are arranged under them at an H2 distance, H2+H3 is less than H/2 and the H1 distance between tie bars (25, 27; 26, 28) and half the H thickness of the slabs (13) is of sufficient magnitude so that sub-slabs (21) can transmit negative bending moments between them wherein the tie bars (26, 28) are bars successively arranged on one side and then on the other side of superficial grooves (15, 17); and the slabs (13) form a convex curvature outside the sub-slabs (21) on which the load acts.

2. The pavement (11) according to claim 1, wherein these tie bars (25, 27) are bars arranged perpendicularly to these superficial grooves (15, 17).

3. The pavement (11) according to claim 1, wherein:

the surface of slabs (13) is between 2×2 m 2 and 25×25 m 2;

the surface of the sub-slabs (21) is between 0.4×0.4 m2 and 5×5 m2;

the H thickness of slabs (13) is between 6-80 cm.

4. The pavement (11) according to claim 1, wherein the tie bars (26, 28) are a sequence of semicircles whose inflection points are in the vertical plane of the superficial grooves (15, 17) and alternated in relation to that plane.

5. The pavement according to claim 1, wherein the length of the tie bars (26, 28) ranges from 1.5 to 5 times the total length of their superficial groove (15, 17).

6. The pavement (11) according to claim 1, wherein said superficial grooves (15, 17) are parallel to the edges of the slabs (13).

7. The pavement (11) according to claim 1, wherein:

H3 is between 5-25% of H;

H2 is between 0-25% of H.

8. The pavement (11) according to any of claim 1, wherein the tie bars (25, 27; 26, 28) are corrugated stainless steel bars.

9. The pavement (11) according to claim 8, wherein the diameter of the tie bars (25, 27; 26, 28) is between 2-10 mm.

* * * * *